US008381957B2

(12) United States Patent
Bürli et al.

(10) Patent No.: US 8,381,957 B2
(45) Date of Patent: Feb. 26, 2013

(54) BAG DISPENSER

(76) Inventors: Hugo Bürli, Fürigen (CH); Samuel Bürli, St. Erhard (CH)

( * ) Notice: Subject to any disclaimer, the term of this patent is extended or adjusted under 35 U.S.C. 154(b) by 384 days.

(21) Appl. No.: 12/444,688

(22) PCT Filed: Sep. 26, 2007 (Under 37 CFR 1.47)

(86) PCT No.: PCT/CH2007/000474
§ 371 (c)(1), (2), (4) Date: Apr. 8, 2009

(87) PCT Pub. No.: WO2008/043189
PCT Pub. Date: Apr. 17, 2008

(65) Prior Publication Data
US 2010/0044392 A1 Feb. 25, 2010

(30) Foreign Application Priority Data
Oct. 13, 2006 (CH) ..... 1629/06

(51) Int. Cl.
*B65H 35/10* (2006.01)

(52) U.S. Cl. ..... 225/14; 225/15; 225/77

(58) Field of Classification Search ..... 225/14, 225/15, 7, 10, 34, 77; 222/81
See application file for complete search history.

(56) References Cited

U.S. PATENT DOCUMENTS

| | | | | |
|---|---|---|---|---|
| 4,648,530 | A * | 3/1987 | Granger | 221/34 |
| 4,793,539 | A * | 12/1988 | Haenni et al. | 225/106 |
| 4,846,415 | A * | 7/1989 | Jernberg et al. | 242/419.4 |
| 4,930,385 | A * | 6/1990 | Wilfong et al. | 225/106 |
| 5,810,234 | A * | 9/1998 | Burli | 225/106 |
| 5,921,390 | A * | 7/1999 | Simhaee | 206/390 |
| 5,927,488 | A * | 7/1999 | Gray | 206/237 |
| 2003/0029881 | A1 * | 2/2003 | Trunsky | 221/45 |

* cited by examiner

*Primary Examiner* — Sean Michalski
(74) *Attorney, Agent, or Firm* — Da Vinci Partners LLC

(57) ABSTRACT

The invention relates to a bag (30) dispenser comprising a receptacle (10) inside which a supply of bags (30) is located. Said bags (30) form a supply roll (37). The dispenser further comprises a device for accommodating or mounting said roll (37) in a housing (1). The housing (1) has at least one gap (17) through which individual bags (30) can be discharged from the housing (1). One respective tearing mechanism (20) is assigned to said gap (17).

8 Claims, 7 Drawing Sheets

Figure 1:
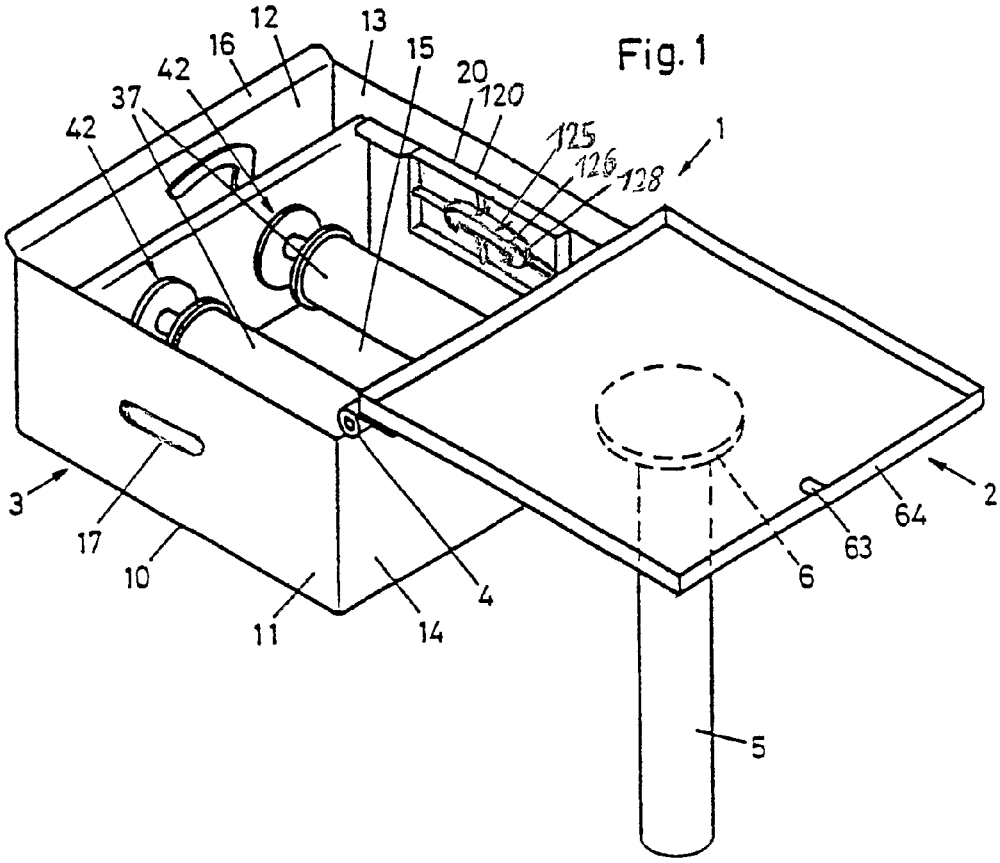

12
13
16
15
42
20
37
120
42
125
126
128
1
3
17
10
11
14
4
6
63
64
2
5

15
17
23
11
14
12
135
60
124
3
4
1
6
2
16
5

BAG DISPENSER

The present application is the US National Stage of PCT Patent Application No. PCT/CH2007/000474 filed 26 Sept. 2007 through which this application claims priority to Swiss Patent Application No. 1629/06 filed 13 Oct. 2006, the content of which is incorporated herein by reference thereto and relied upon.

The present invention relates to a dispensing apparatus for bags having a housing, in which a supply of bags is located, these bags forming a web which is rolled together into a roll, having a device for receiving and/or mounting the roll, having a gap which is implemented in at least one of the walls of the housing, and through which the bags may be discharged from the housing, and having a tear-off device, which is assigned to the dispensing gap.

A dispensing apparatus of the species is disclosed, for example, in CH-C 474 232. This dispensing apparatus has a rear wall and support elements protrude from the lateral edges of this rear wall for fastening a reserve container for rolled-up plastic bags. A trough-shaped floor is provided in the reserve container, on which the roll made of the plastic bags lies. The plastic bags may be pulled out through a slotted opening in the reserve container and detached from the remaining supply of plastic bags on a jagged tear-off edge of the container.

This previously known dispensing apparatus has multiple disadvantages. The withdrawal of the bags from the supply is unbraked, so that more than one bag may be pulled out of the container if one does not pull on the bag web carefully enough. If more bags than necessary have been pulled out of the container, it is practically impossible in this apparatus to roll back the roll, in order to put the excess bags back in the container.

A further disadvantage of this previously known apparatus is that it may not be set up outside. The cited open gap on the supply container represents one of these impediments. This gap cannot be sealed against the penetration of rainwater, for example. The bags are made of plastic. It is known that plastic adheres comparatively solidly on smooth and wet surfaces, for example, on the surface of a metal part. For example, rainwater in the cited housing or in the trough having the bag roll would cause the exterior of the bag located currently in the peripheral area of the roll to remain stuck strongly on the wet surface of the trough. The supply roll would deliver an irregular resistance upon withdrawal of the bags, so that multiple bags could be pulled out of the container unintentionally, with the disadvantageous consequences described above.

Apparatuses are also known in which the bags may be braked as they are pulled out and torn off, but they may or should only be set up where they are not subjected to snow, rain, or the influence of cold, because the dispensing gap, in particular the brake, practically freezes over due to penetrating moisture.

The object of the present invention is to remedy these and still further disadvantages of the prior art.

The object is achieved according to the invention in the apparatus of the species cited at the beginning as defined in the characterizing part of Claim 1.

Figure 2:
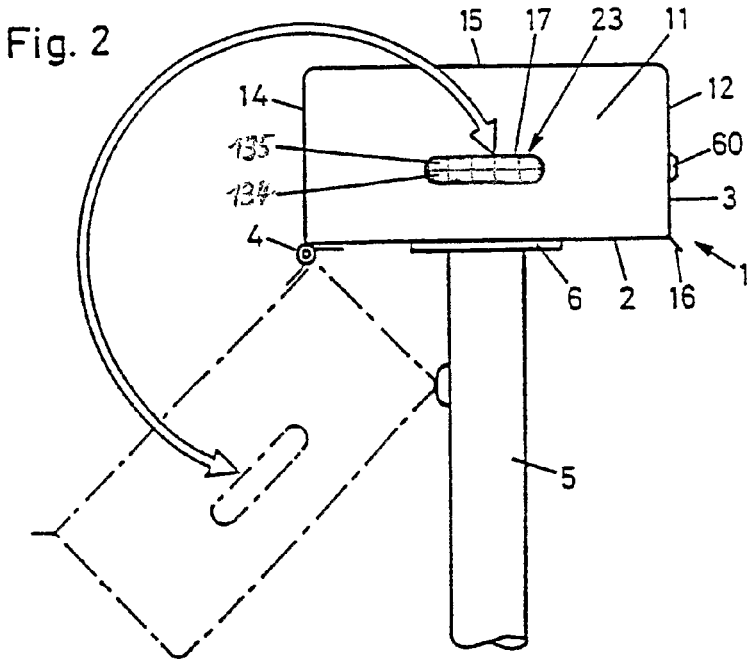
Figure 3:
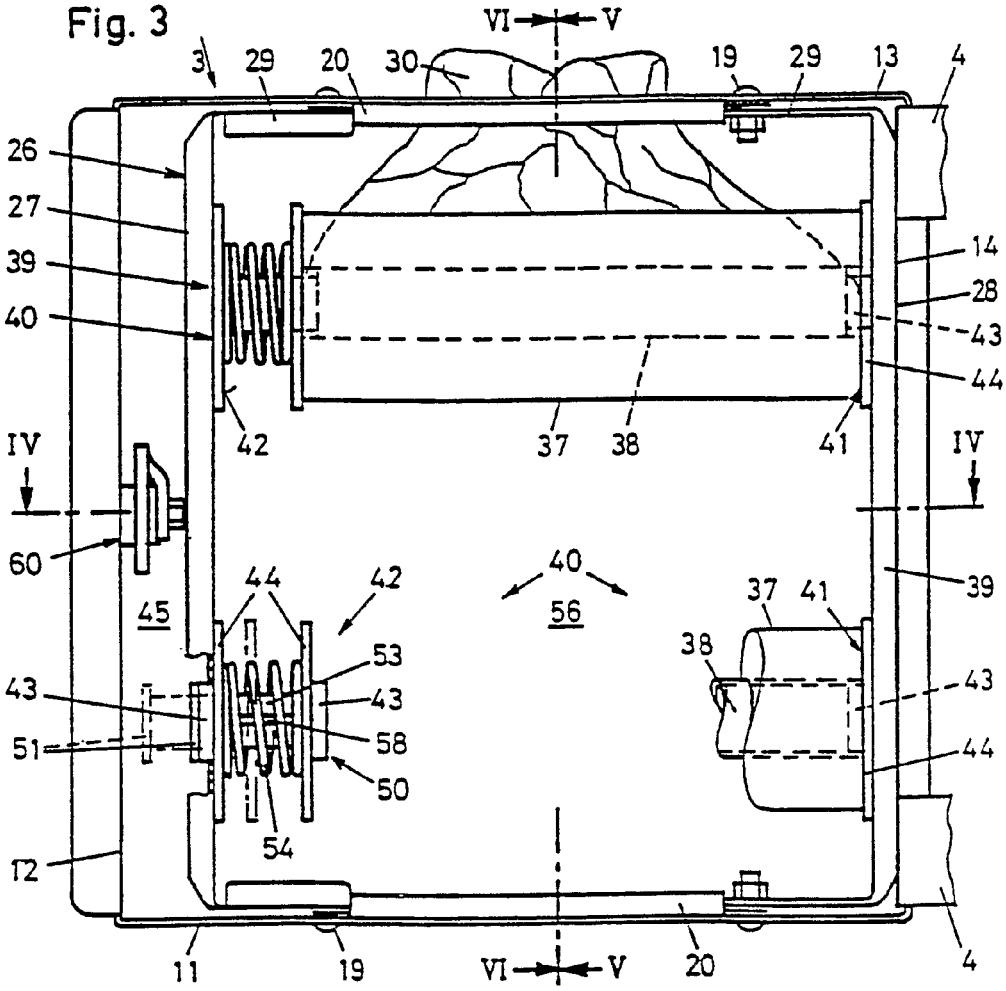
Figure 4:
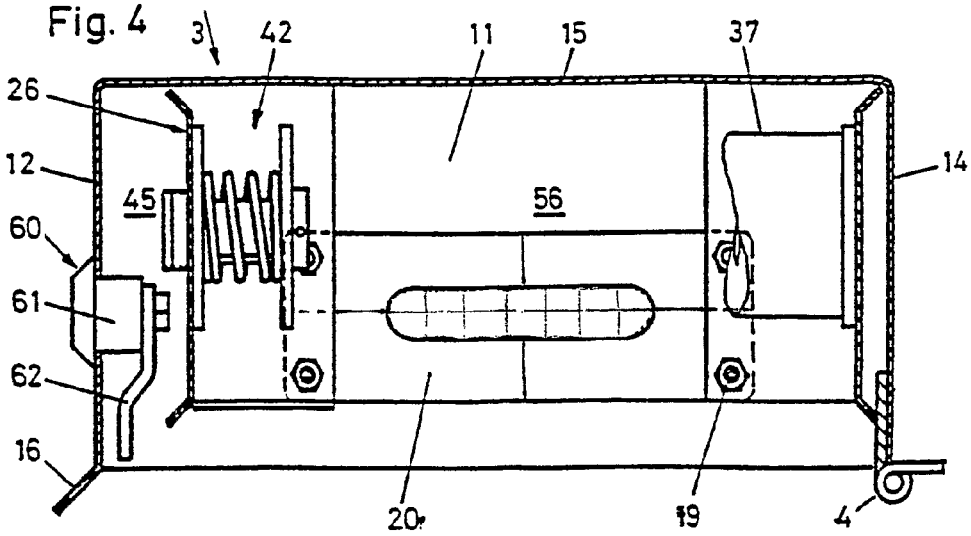
Figure 5:
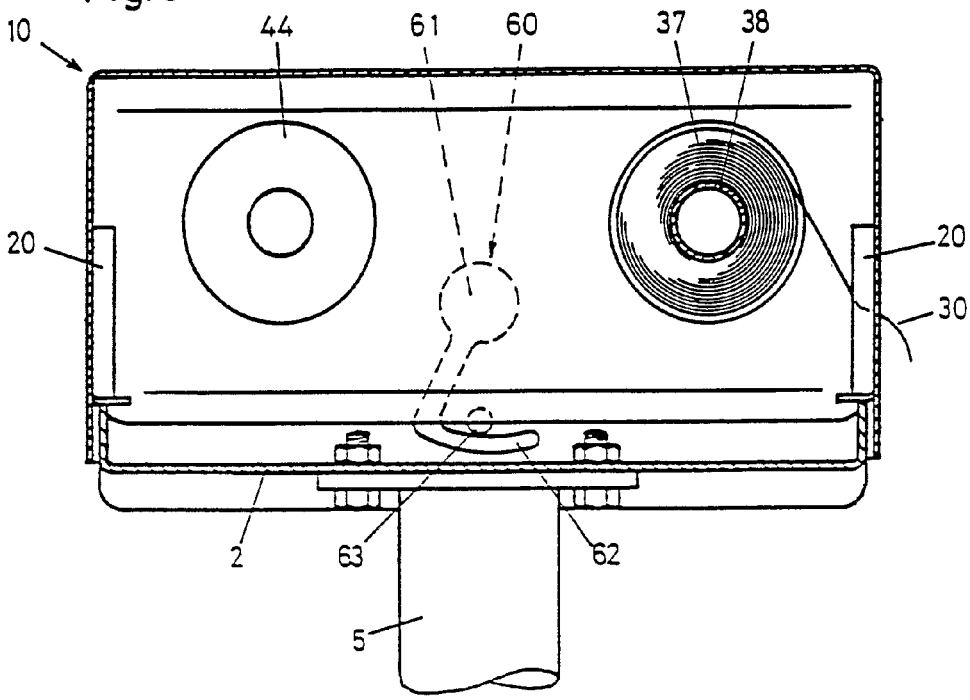
Figure 6:
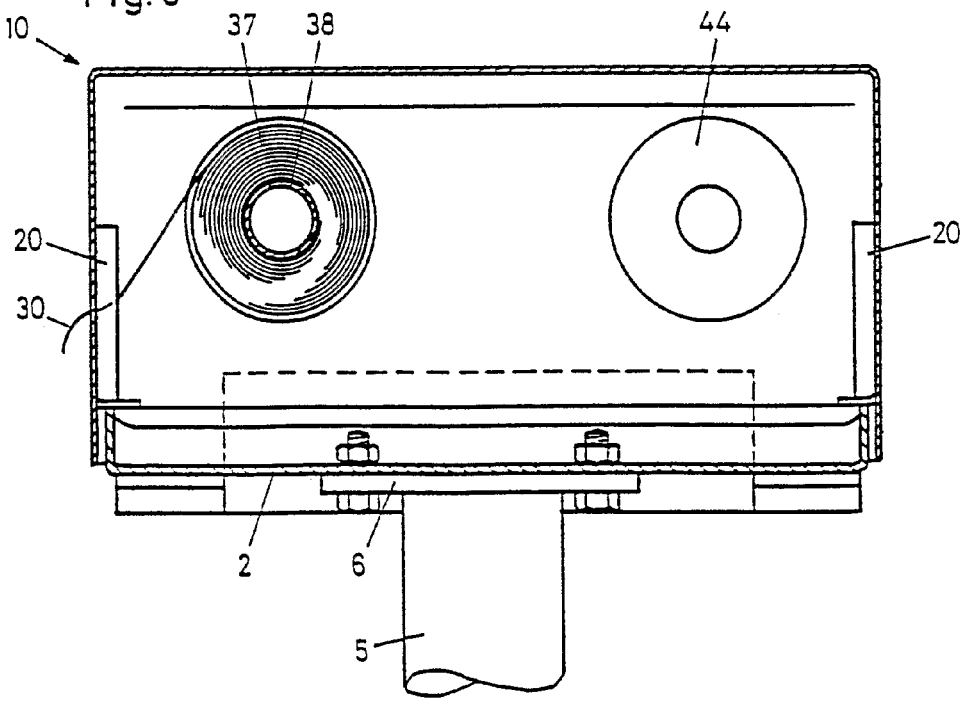
Figure 7:
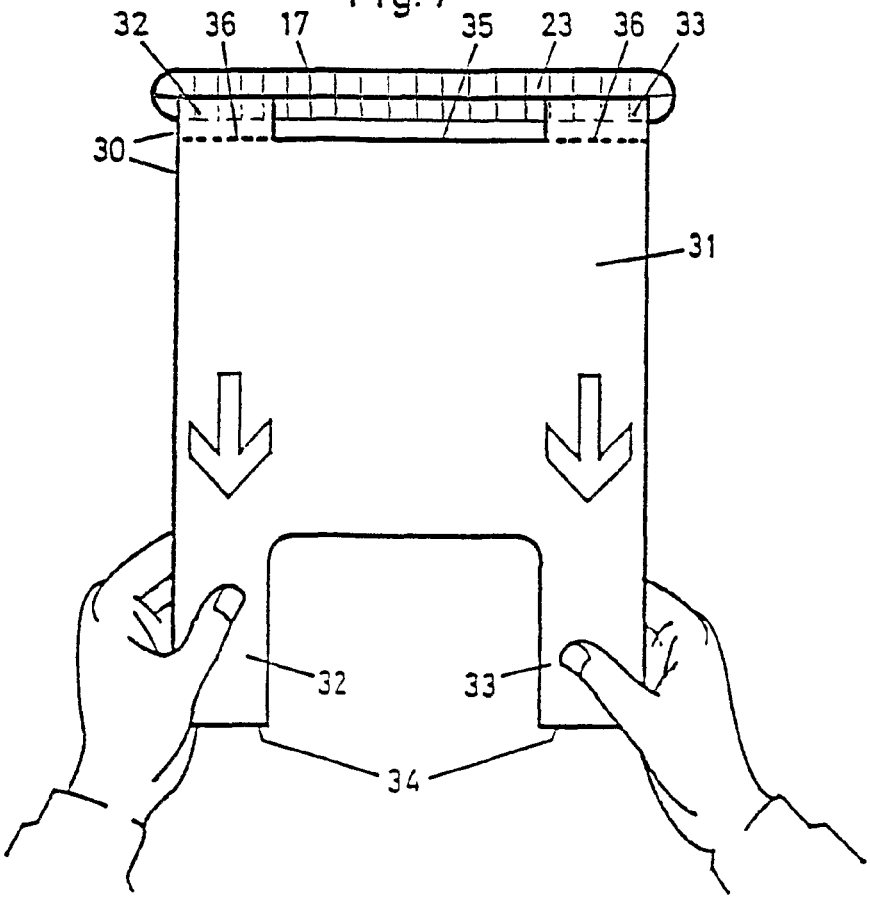
Figure 8:
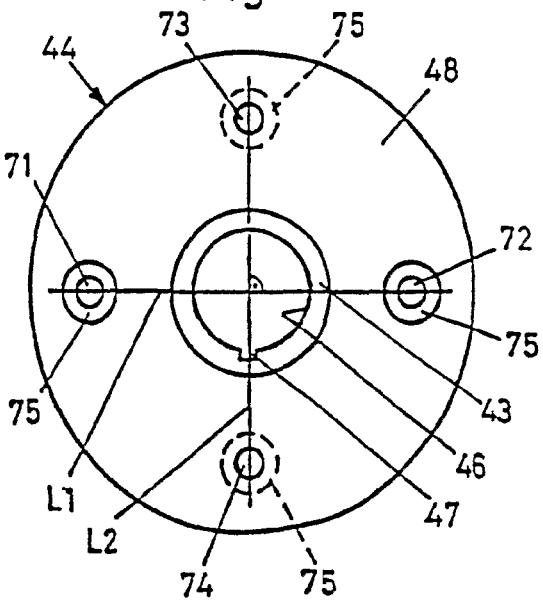
Figure 9:
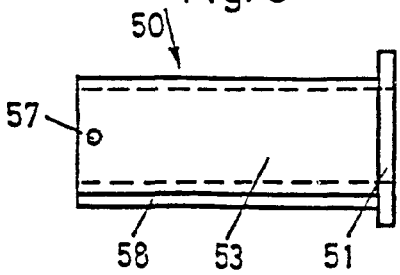
Figure 10:
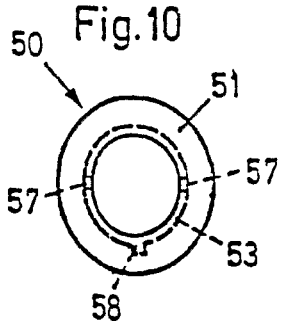
Figure 11:
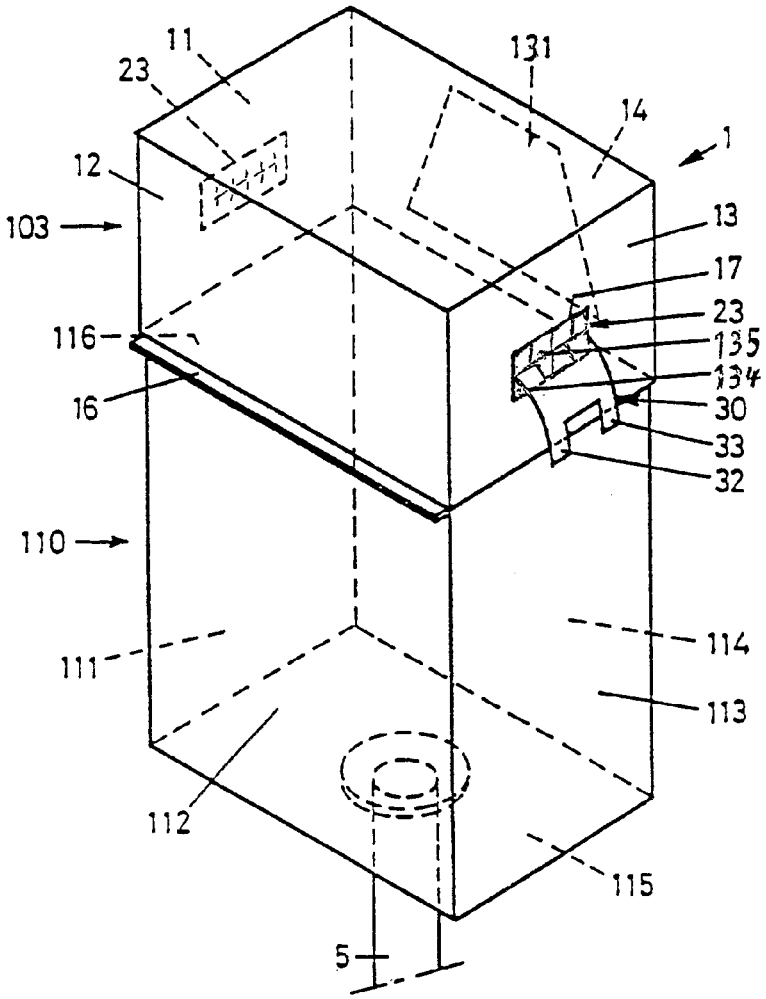
Figure 12:
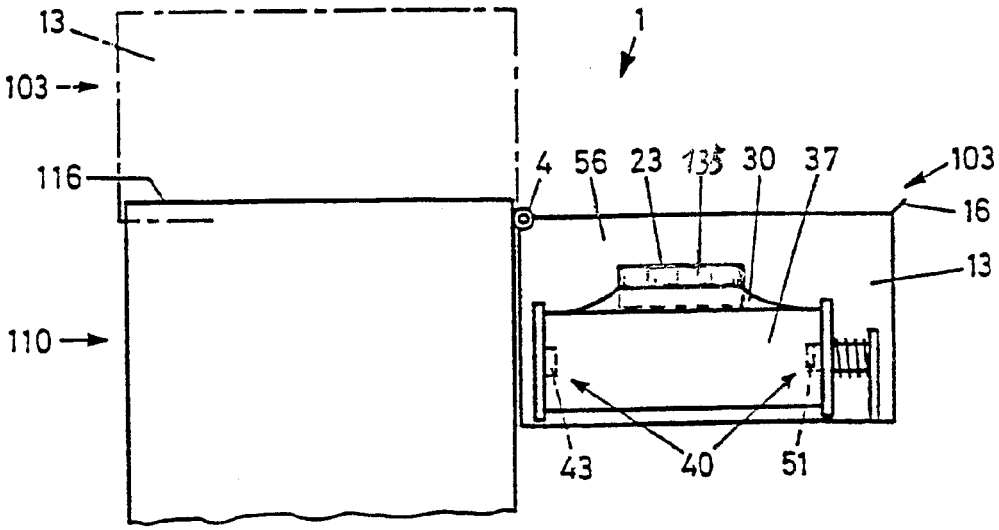
Figure 13:
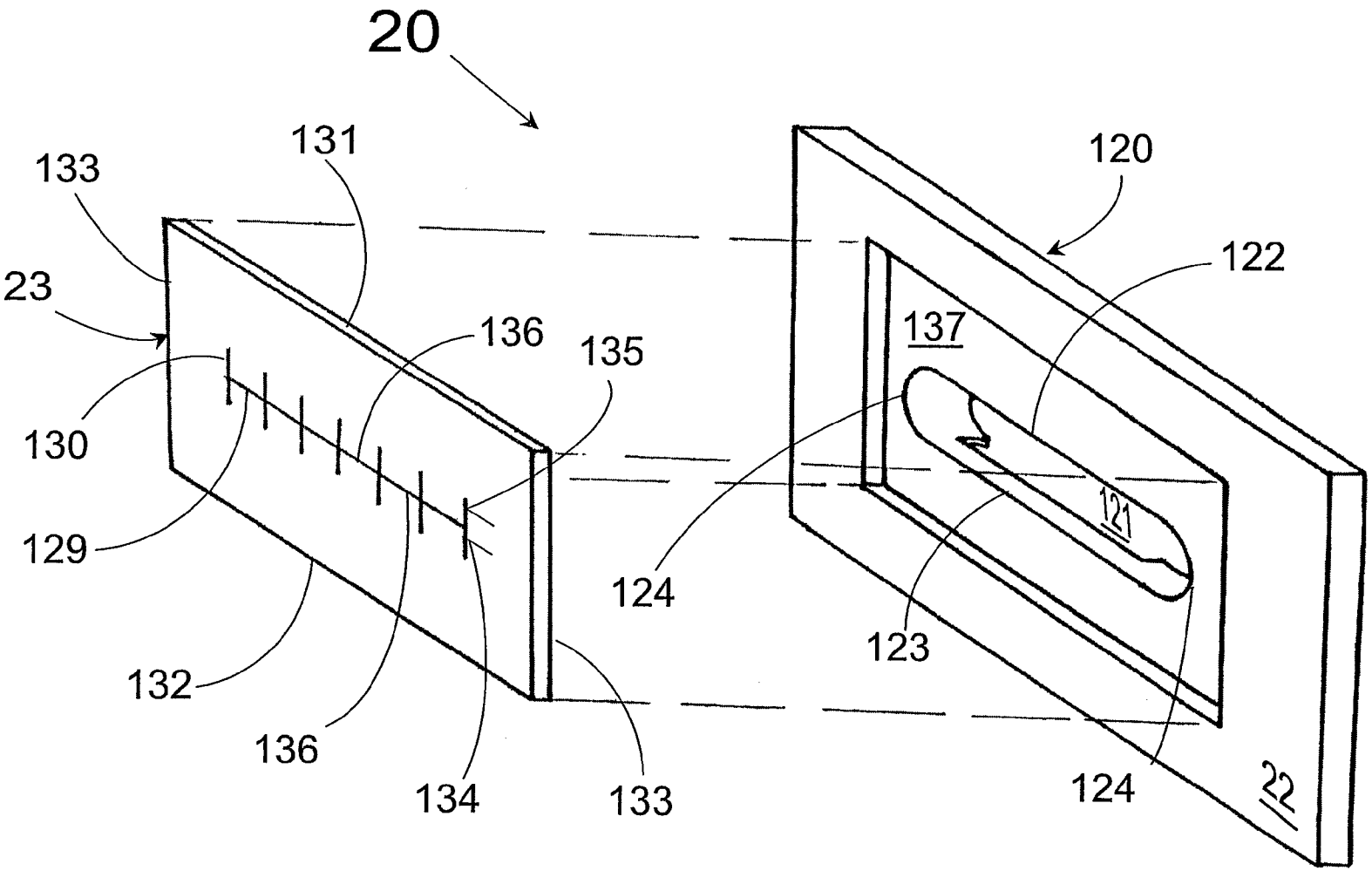
Figure 14:
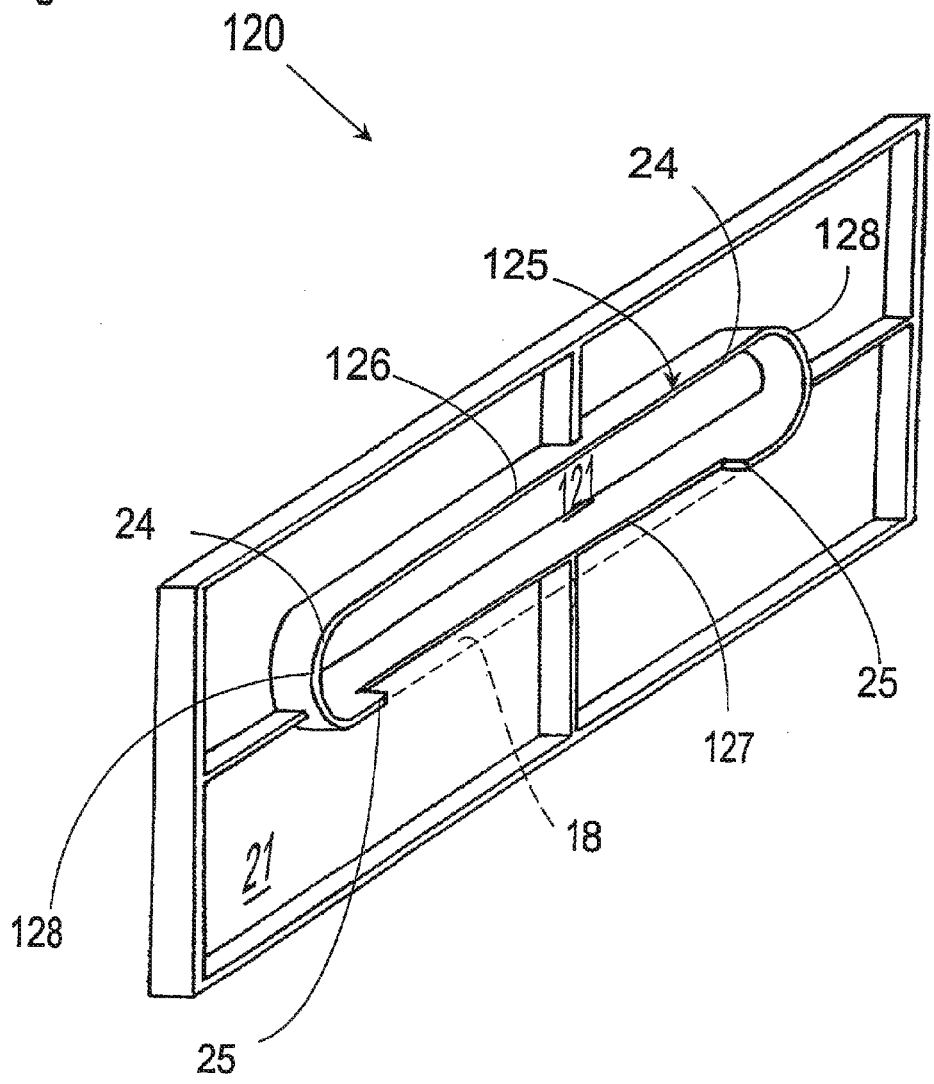

Embodiments of the present invention are explained in greater detail on the basis of the appended drawings hereafter. In the figures:

FIG. 1 shows the present apparatus in perspective, after the top part thereof has been folded away to the side, FIG. 2 shows a side view of the apparatus according to FIG. 1, when it is in the operationally-ready state, FIG. 3 shows a top view of the interior of the top part of the apparatus according to FIG. 1, when the top part thereof is located in the folded-away position already noted, FIG. 4 shows the top part of the apparatus according to FIG. 4 in a vertical section IV-IV, when it is in the operationally-ready state, FIG. 5 shows the apparatus according to FIGS. 1 and/or 4 in a section V-V, this section being guided perpendicularly to the longitudinal axis of supply rolls having bags, FIG. 6 shows a vertical section VI-VI through the present apparatus, which is rotated by 180° in relation to section V-V according to FIG. 5, FIG. 7 shows bags which have been pulled out of the apparatus from one of the supply rolls, FIG. 8 shows a top view of a front disc on which one of the supply rolls rests on one end, FIG. 9 shows a side view of a pin on which the front disc according to FIG. 8 may be seated, FIG. 10 shows a frontal view of the pin according to FIG. 9, FIG. 11 shows a perspective view of a further embodiment of the present apparatus, FIG. 12 shows a side view of the apparatus according to FIG. 11, after the top part of this apparatus has been folded away laterally, FIG. 13 shows an exploded and perspective view of a tear-off device having braking means, and FIG. 14 shows a perspective view of the rear of the tear-off device having its guide means.

FIG. 1 of the appended drawings shows the present apparatus in perspective and FIG. 2 shows this apparatus in a side view. The present dispensing apparatus has a housing 1. This housing 1 is essentially in two parts and it comprises an essentially horizontal base plate 2 and a top part 3. The top part 3 is assigned to the base plate 2 and is linked on the base plate 2 with the aid of a hinge 4. A pedestal 5 is fastened to the bottom side of the base plate 2. In the case shown, the pedestal 5 is implemented as a column, whose top end is fastened on the base plate 2 with the aid of a head plate 6. The bottom end of the column 5 is implemented in accordance with the particular situation. This end part of the column 5 may be smooth if the column 5 is to be sunk into the ground or a similar support. This end part of the column 5 may also be provided with a foot plate (not shown), however, if the column 5 is to be screwed together with the foundation, for example.

The housing top part 3 comprises a container 10, which is open on one side and thus has a mouth in this area. This container 10 has four side walls 11, 12, 13, and 14 and a floor 1. The hinge 4 is attached on one side on the free edge of one of the side walls 14. The other side of the hinge 4 is connected to one of the edges of the base plate 2. The free edge of the opposing container side 12 is provided with a material strip 16, which protrudes diagonally from the container body and/or the container shell, and which is to make opening the housing 1 easier.

The side walls 11 through 14 and the floor 15 together form one piece and such a container shell is implemented from an impact-proof material, such as aluminum, plastic, or a similar material. In the operationally-ready state, the mouth of the container rests on the base plate 2, so that the container shell covers the content of the housing 1 like a cover. The interior of the housing 1 is protected against the penetration of water, dirt, etc. by a container shell implemented in this way.

A dispensing gap 17 is implemented in at least one of the container walls 11 through 14, to which a tear-off device 20 is assigned. The cited assignment is performed in such a way that the tear-off device 20 overlaps the dispensing gap 17 from the outside or the inside. The tear-off device 20 assigned as shown to the dispensing gap 17 largely prevents rainwater, dirt, and other objects from reaching the interior of the housing 1.

The tear-off device 20 is implemented as an independent unit (FIGS. 13 and 14), which may be fastened to the wall 11 through 14 of the container 10. The tear-off device 20 has an essentially plate-shaped main body 120 having the large surfaces 21 and 22. A guide gap 121 is implemented in this main body 120. This guide gap 121 has two linear sections 122 and 123, which are spaced apart from one another. Furthermore, the guide gap 121 has semicircular sections 124, between whose end parts the linear sections 122 and 123 extend. These sections 122, 123, and 124 delimit the contour of the guide gap 121. The main body 120 of the tear-off device 20 is assigned to the wall 11 through 14 of the housing 1 so that the opening in the guide gap 121 and the opening in the dispensing gap 17 align with one another.

The contour of the guide gap 121 is assigned a guide means 125 for the bags 30. This guide means 125 is implemented as a lip-like or mouthpiece-like formation 125 which projects from one of the large surfaces 21 of the main body 120 of the tear-off device 20. This mouthpiece 125 comprises end sections 128, which protrude from the main body 120 of the tear-off device 20, and which are semicircular, each of these semicircular end sections 128 having end parts 24 and 25. The particular end section 128 of the mouthpiece 125 is assigned to one of the semicircular end sections 124 of the guide gap 121 and is thus guided around the particular end area of the guide gap 121 of the tear-off device 20. The inner surface of the semicircular end sections 128 of the mouthpiece 125 is flush with the inner surface of the semicircular end sections 124 of the guide gap 121.

The mouthpiece 125 also has, in the illustrated caser a first, linear section 126 which also projects from the first large surface 21 of the main body 120. This linear projection 126 is assigned to the upper linear peripheral section 122 of the guide gap 121 of the tear-off device 20 and extends along this section 122 of the guide gap 121. The end parts of this linear projection 126 are attached to the first end parts 24 of the semicircular end sections 128 of the mouthpiece 125 so that they are integral with these first end parts 24 of the end sections 128. The inner surface of the linear projection 126 is flush with the inner surface of the upper linear peripheral section 122 of the guide gap 121. As a result, the opening in the mouthpiece 125 is flush with the opening in the guide gap 121.

In the embodiment of the tear-off device 20 just described, a free space 18 is provided between the second end parts 25 of the semicircular end sections 128 of the mouthpiece 125. This allows the orientation of the location of the tear-off device 20 to be adapted to the direction from which the bags 30 to be torn off are supplied. This is because the axis of the roll which contains the bags is normally at the height of the guide gap 121. The area of the circumference of the bag roll from which the bags are pulled off is therefore above or below the guide gap 121. The cited free space 18 allows the orientation of the tear-off device 20 to be adapted to these two situations.

However, still a further embodiment of the tear-off device is possible, in which the mouthpiece 125 has yet a second or lower and also linear projection (not shown), which fills up the cited free space 18. Such a second projection thus extends between the second end parts 25 of the semicircular end sections 128 of the mouthpiece 125. This linear projection is assigned to the lower linear peripheral section 123 of the guide gap 121 of the tear-off device 20 and extends along this section 123 of the guide gap 121. The inner surface of this linear projection is flush with the inner surface of the lower linear peripheral section 123 of the guide gap 121. As a result, the opening in the mouthpiece 125 is also flush with the opening in the guide gap 121 in this case.

An extensive recess 137 is provided in the second large surface 22 of the main body 120 of the tear-off device 20. This recess 137 is rectangular and is implemented as a depression in the large surface 22 of the main body 120 of the tear-off device 20. If the tear-off device 20 is assigned to the housing 1 this depression 137 faces toward the inner side of one of the walls 11 or 13 of the housing 1.

The recess 137 of the tear-off device 20 is assigned a braking means 23, in such a way that this braking means 23 lies on the interior of the cover 21. The braking means 23 is practically implemented as a rectangular plate and the material of this plate is preferably rubber having a high coefficient of friction in relation to the material of the bags 30. The brake plate 23 has a longer slot 129 and a row of shorter slots 130. The long linear slot 129 runs parallel and practically in the middle between the long sides 131 of the rectangular brake plate 23. The long slot 129 extends in the case shown between the first and the last short slots 130. The short slots 130 are so long that they begin at a distance in front of one of the long sides 132 of the brake plate 23, and they end practically at the same distance at the opposing, other long side 132 of the brake plate 23. The short, also linear slots 130 run perpendicularly to the long slot 129 of the brake plate 23 and are situated parallel to one another. The row of the shorter slots 130 begins at a distance to the shorter side 133 of the brake plate 23 and ends practically at the same distance at the opposing second shorter side 133 of the brake plate 23. Through this configuration of the slots 129 and 130, the brake plate 23 receives the appearance of the front of an upper row of teeth 135 and a lower row of teeth 134 in a set of teeth when the teeth 136 bite against one another. The ends of the teeth 136, which abut one another in the illustrated case, represent the actual brake.

The dimensions of the distances and the number of the shorter slots 130 are selected depending on the stiffness of the teeth and depending on the dimension of the force which is necessary to tear off the frontmost bag.

A supply of bags to be dispensed is located in the interior of the container 1. The particular bag 30 (FIG. 7) has the shape of a T-shirt and it has a bag-shaped main body 31. Loops 32 and 33, which may be used to carry the filled bag 30, adjoin the main body 31 in the area of the mouth of the bag main body 31.

The bags 30 are connected one behind another and thus form a web. In this web, the front edge 34 of the loops 32 and 33 adjoins the floor edge 35 of the bag main body 31 in each case. At the transition between the loops 32 and/or 33 and the floor 35 of the adjacent bag 30, a perforation 36 is implemented, which extends practically along the bag floor edge 35. This perforation 36 represents an intended breakpoint, in order to achieve a clean separation of the bags 30 from one another in the present apparatus. On the other hand, through a suitable implementation of the perforation, the force which is necessary at a given braking force of the braking means 23 for tearing off the particular frontmost bag from the following bag may be controlled.

The bag web is rolled together into a roll 37 (FIG. 3), which is wound onto a tubular core 38 (FIG. 5) made of cardboard or similar material. In the present case, two rolls 37 are located in the container 10. One of these rolls 37 is assigned to each of the side walls 11 or 13 (FIG. 3), respectively, of the container 10. The dispensing gap 17 is implemented in each of the side walls 11 and/or 13 and a tear-off device 20 is assigned in the way already described to each dispensing gap 17. The long slot 129 of the brake plate 23, which is available for the passage of the bags 30 between the teeth 136 of the tear-off device 20, runs linearly and the length of this slot 129 is shorter than the width of the bag 30 located in the supply package 37.

In order that a resistance of the roll 37 which is independent of weather, for example, during the rotation thereof is ensured, the roll 37 must be mounted so it is rotatable in the housing 1. In addition, this mounting must be implemented so that the rolls 37 may be replaced as easily and simply as possible. Devices 40 are provided for the mounting of the particular rolls 37, which are situated in the container 10 and which may be moved in relation to the base plate 2 of the apparatus together with the apparatus top part 3 and/or maybe pivoted around the hinge 4. This pivoting of the top part 3 allows the access to the interior of the top part 3 through the mouth thereof, which lies on the bottom in the operationally-ready state of the apparatus and rests on the base plate 2. In the folded-away state, the interior of the top part 3 and/or the container 10 is even accessible from above, so that the replacement of the rolls 37 may be performed.

The mounting devices 40 are situated in the interior of a frame 26 (FIG. 3), which has two approximately U-shaped sections 27 and 28. The webs 39 of the U-shaped frame sections 27 and 28 lie at a distance from one another and run practically parallel to one another. They are sufficiently long that the legs 29 of the frame sections and/or frame halves 27 and 28 press against the inner side of the side walls 11 and 13 of the container 10. The legs 29 of the U-shaped frame sections 27 and 28 are shorter than half of the length of the container sides 11 and 13, which carry the particular tear-off device 20. However, the length of the legs 29 is selected so that the end parts of these legs 29 overlap the edge parts of the tear-off devices 20. This allows the overlapping sections of the particular tear-off device 20 and the particular frame leg 29 to be able to be fastened with the aid of a screw 19 or rivet on the container body 10.

The web 39 of the frame part 28 which is closer to the back 14 of the container 10 presses against the inner side of this container rear wall 14 so that it practically forms a seal. The distance between the webs 39 of the frame halves 27 and 28 is defined above all and/or essentially by the length of the supply roll 37 which extends or is to extend between these webs 39. The length of the side walls 11 and 13 of the container 10 on which the nozzles 20 are fastened is significantly greater than the length of the bag rolls 37, so that a cavity 45 is provided between the web 39 of the frame half 27 closer to the front wall 12 of the container 10 and this front wall 12.

The mounting device 40 has two bearing points 41 and 42 for the mounting of a roll 37. One of these bearing points 41 is fixed, while the other bearing point 42 is implemented as yielding, so that a new supply roll 37 may be laid in the mounting device 40 and/or the roll core 38 may be removed from this mounting device 40.

The fixed bearing point 41 has a disc 44, on which the supply roll 37 may rest on its front face and/or on one end and whose diameter is somewhat greater than the external diameter of a supply roll 37 which has not yet been started. This front disc 44 is shown in a top view in FIG. 8. The outer edge of the main body 48 of this disc 44 has a circular contour. An opening 46, also having a circular contour, is implemented in the middle of the disc main body 48.

The central opening 46 in the disc main body 48 is enclosed by an annular bead 43, which protrudes from the main body 48 and which may be molded on this main body 48. The outer peripheral surface of this circular bead 43 has a diameter which is somewhat smaller than the internal diameter of the opening in the roll core 38. This is because one of the end parts of the roll core 38 may thus be put onto this bead 43. A groove 47 is implemented in the wall of the disc opening 46, whose longitudinal axis runs parallel to the axis of the central opening 46 in the disc 44.

Pairs of through holes 71 and 72 and also 73 and 74 are implemented in the plate-shaped main body 48 of the disc 44, whose axes also run parallel to the axis of the central opening 46 in the disc main body 48. These holes 71 through 74 are located at equal distances from the middle of the disc body 48. The holes of the particular pair are diametrically opposite to one another. Lines L1 and L2 which connect the holes 71 and 72 or 73 and 74 of the particular pair are perpendicular to one another. The starting part of the particular hole is provided with a countersunk hole 75, in which the head of a fastening screw may find space. For one pair of the holes 71 and 72, the countersunk holes 75 are on one side of the disc body 48, while for the other pair of the holes 73 and 74, the countersunk holes 75 are located on the opposite side of the disc body 48. This implementation of the disc allows the same discs 44 to be able to be used at both bearing points 41 and 42.

The front disc 44 of the fixed bearing point 41 is fastened with the aid of a pair of screws (not shown) to the inner side of the rear frame half 28, in such a way that the bead 43 on this disc 44 faces away from the cited frame half 28. The screws go through one of the pairs of the diametrically opposing holes 71 and 72 or 73 and 74 in the disc main body 48, the heads of the screws being countersunk in the countersunk hole 75 of the outer side of this disc 44. As a result, the edge of the supply roll 37 resting on this outer side of the disc 44 may slide unobstructed on this disc side when a further bag is pulled off of the supply roll 37. The bead 43 on the disc main body 48 centers this end of the supply roll 37 in relation to the front disc 44.

The yielding bearing point 42 of the mounting device 48 has two discs 44 of the embodiment just described and an essentially cylindrical pin 50 (FIG. 3). This pin 50 is shown in a side view in FIG. 9 and in a front view in FIG. 10. It has a cylindrical main body or middle part 53. This pin main body 53 is hollow and the external diameter of this main body 53 is somewhat smaller than the diameter of the central opening 46 in the disc 44, so that the pin body 53 may be put through the central opening 46 in the particular disc 44 with slight play. A wedge 58 is implemented on the outer side of the pin main body 53, which protrudes from the outer side of the pin body 53 and/or is raised therefrom and which runs in the axial direction of the pin body 53. This wedge 58 comes to rest in the groove 47 in the central opening 46 when the pin body 53 passes through the disc 44. This prevents the disc 44 from being able to rotate on the pin 50.

A collar 51 is located on one end of the cylindrical pin body 53. This collar 51 may be molded onto this pin end and may thus be integral with the remaining part of the pin 50.

One of the discs 44 of this yielding bearing point 42 is fastened on the frame half 27 closer to the front side of the container 10. This fastening is performed, similarly as with the disc 44 of the fixed bearing point 41, with the aid of two screws (not shown), which go through two of the diametrically opposing holes 71 and 72 or 73 and 74, the heads of the screws being countersunk in the relevant countersunk holes 75. This disc 44 is attached to the inner side of the frame half 27. An opening is implemented in this frame half 27, whose diameter is somewhat larger than the external diameter of the bead 43 on one of the discs 44. The disc 44 attached on this frame half 27 is oriented so that its bead 43 lies in the opening of this frame half 27. The pin 50 is inserted into this disc 44 so that its collar 51 lies on the outer side of the frame half 27, i.e., in the free space 45, and may also move in this space 45. Because the wedge 58 lies in the recess and/or in the groove 47 of the particular disc 44, the pin 50 may move in the opening 46 of the disc 44 in its longitudinal direction, but cannot rotate in this opening 46.

The second of the cited discs 44 of this yielding bearing point 42 is situated on the opposite end of the pin 50, which is in the roll chamber 56. This disc 44 is oriented so that the bead 43 on this front disc 44 faces toward the interior of the roll chamber 56 and/or the frame. The front face of the bead 43 expediently lies in the same plane as the front face of this end part of the pin main body 53. A hole 57 (FIG. 9) is implemented in this end part of the pin 50, specifically where the bead 43 of the disc 44 is located. A corresponding transverse hole is implemented in the bead 43. The transverse holes in the bead 43 and in the pin body 53 are brought into alignment and a heavy dowel pin is plugged through these openings. This inner disc 44 is thus fastened on the pin body 53 and secured against displacement along the pin body 53. The disc 44 is secured against rotation in relation to the pin body 53 with the aid of the wedge 58 on the pin body 53, whose corresponding section rests in the groove 47 of the bead opening 46.

The section of the pin body 53 which extends between the two discs 44 of this yielding bearing point 42 is enclosed by a coiled spring 54. This coiled spring 54 is supported at one end on the inner side of the front disc 44 fastened on the front frame half 27. The other end of the compression spring 54 is supported on the inner side of the other front disc 44, which is located on the inner end of the pin 50. The diameter of the coiled spring 54 may be significantly greater in certain circumstances than the external diameter of the pin body 53. To center the location of such a spring 54 in relation to the pin body 53, the particular disc 44 may be provided with a second bead (not shown). This bead is implemented practically identically to the first bead 43, which was already described. This second bead is situated on the side of the disc main body 48 opposite to the first bead 43, however. In FIG. 8, the second bead is located behind the first bead 43 visible in FIG. 8. The external diameter of the second bead corresponds to the internal diameter of the coiled spring 54, so that this bead may find space in one of the end parts of the coiled spring 54 and may thus hold this spring 54 at a predetermined distance from the pin body 53.

If a bag roll 37 is to be inserted into the container, one end of this roll 37 is first placed on the bead 43 on the inner roll disc 44. Subsequently, this roll disc 44 is pressed by the supply roll 37 approximately in the axial direction of the pin 50, so that the pin 50, which is connected to this disc 44 via the heavy dowel pin, is displaced outward, i.e., into the intermediate space 45. The other end of the roll 37 may then be lowered enough that this roll end may be put onto the bead 43 of the front disc 44 of the fixed bearing point 41. The first bag 30 of this supply roll 37 may then be inserted into the slot 129 of the brake plate 23 in the tear-off device 20 and this roll 37 is then ready for operation.

The present apparatus is equipped with bearing devices 40 for two supply rolls 37 and with two tear-off devices 20. In the illustrated case, the supply rolls 37 are situated parallel to one another and the tear-off devices 20 are assigned to the opposing side walls 11 and 13 of the container.

The front wall 12 of the container 10 is provided with a lock 60. This lock 60 comprises a cylinder 61 of a known construction, which passes through the front wall 12. A hook 62, which may engage behind a pin 63, which is attached to the base plate 2 of the housing 1, is attached to the end of this cylinder 61 which is located in the intermediate space 45. The edge 64 (FIG. 1) of the base plate 2 is bent upward and the pin 63 is fastened on the inner side of this edge part of the base plate 2. With the aid of a special key, for example, a key having an opening of triangular cross-section, the hook 62 of the lock 60 may be pivoted and thus engaged or disengaged with the pin 63.

A further possible embodiment of the present apparatus is shown in FIGS. 11 and 12, FIG. 11 showing this apparatus in a perspective view. FIG. 12 shows the present apparatus in a side view, after the top part of this apparatus has been folded away laterally.

This embodiment of the present apparatus is also in two parts and it has a top part 103 and the bottom part 110. The top part 103 of this apparatus is extensively similar to the top part 3 of the apparatus according to FIG. 1. One difference in relation to the top part 3 according to FIG. 1 is represented by an opening 131, which is implemented in one of the side walls and advantageously in the front wall 14 of the top part 103. This opening 131 is approximately in the middle of the width of the container wall 14 and thus lies between the supply rolls 37 already described. This opening 131 thus opens into the roll chamber 56 in the top part 103.

The bottom part 110 of this apparatus is implemented as a hollow body, which is open on one side. In the illustrated case, the bottom part 110 is practically cuboid, although it may also be cube-shaped or a similar shape. The most important condition for the shape of the bottom part is that it has an opening or mouth 116, which may be covered by the top part 103 and through which the cavity 156 in the top part 103 and the cavity in the bottom part 110 are connected to one another.

The bottom part 110 (FIG. 11) has side walls 111, 112, 113, and 114 and a floor 115. The pedestal 5 already described is attached to the outer side of the floor 115 and projects practically perpendicularly from this floor 115. Instead of the pedestal 5 implemented as a pillar or column, a bracket (not shown) may be attached to the floor 115, so that such an apparatus may also be attached or fastened to a wall. In its upper area, the bottom part 110 has a mouth 116, which lies practically in a horizontal plane and which may be covered by the top part 103. The edge part of the top part 103 is assigned to the edge part of the bottom part 110 in such a way that the mouth in the container 10 of the housing top part 103 is seated on the mouth 116 of the housing bottom part 110. For this purpose, the horizontal sections guided by the top part 103 and the bottom part 110 have practically the same shape and practically the same dimensions. The edge of a bag, such as a garbage bag (not shown), whose remaining part is located in the interior of the bottom part 110, may be clamped between the edges of the top part 103 and the bottom part 110. Objects which are to be placed in such an apparatus are thrown through the opening 131 in the housing top part 103 into the interior 56 thereof. Such objects then go through the mouth 116 of the bottom part 110 therein and thus also into the bag in free fall. Upon opening of the cover 103, the bottom part opening 116 is exposed, so that the bottom part 110 may be emptied.

The top part 103 is attached so it is pivotable with the aid of the hinge 4 already described on the bottom part 110, so that the top part 103 may be folded away laterally from the bottom part 110, as shown in a side view in FIG. 12. In this position of the top part 103, the bearing points for the bag rolls are located on the top side of the housing top part 3 or 103. There is no cover of the supply rolls 37 in relation to the remaining part of the interior 56 of the top part 103 in the top part 103. As a result, the inner chamber of this top part 103 is well accessible in order to replace the bag rolls 37, clean the interior of the top part, or similar actions. The circumstance that the bag rolls 37 and the bearing points thereof are exposed in the inner chamber of the apparatus allows access thereto without problems when necessary. Both hands are free for changing the rolls 37 in the present apparatus.

The presence of the cited loops 32 and 33 on the bags also provides the significant advantage that the loops 32 and 33 may be knotted, so that the mouth of the bag main body may thus be closed.

The invention claimed is:

1. A dispensing apparatus for bags having a housing, wherein the apparatus is adapted to receive a supply of bags therein, these bags forming a web rolled up to form a roll, having a device for mounting the roll, having a dispensing gap, which is formed in at least one wall of the housing, and through which the bags may be discharged from the housing, and having a tear-off device, the tear-off device having a main body having a large substantially planar surface and an elongated guide gap formed therein, the guide gap located along a longitudinal axis, the tear-off device being in register with the dispensing gap, and having a guide means, with the aid of which the bags may be guided to be torn off from the bag web, wherein the tear-off device has a break means adjacent thereto, and wherein the guide gap is delimited by a flange structure forming the guide means which projects from the large surface of the tear-off device facing the supply of bags, and wherein further, the guide means is delimited by a free space or cut-out formed exclusively on one side of the flange structure which renders the guide means asymmetric about a plane which passes through the longitudinal axis of the guide gap and which extends perpendicularly from the large surface of the tear-off device the tear-off device being formed to be mountable in two alternate positions so that the guide means suits the incoming direction of the web, whether coming from one tangential side of the roll or from another tangential side of the roll.

2. The dispensing apparatus according to claim 1, wherein the tear-off device is formed so that an extensive recess is in the large surface of the main body of the tear-off device which is adjacent to container wall, and the brake means is located in this recess.

3. The dispensing apparatus according to claim 1, wherein the brake means is essentially a rectangular plate with slots, one long linear slot runs parallel to one of the long sides of the rectangular brake plate, and short, also linear slots are formed perpendicularly to the long slot in the brake plate.

4. The dispensing apparatus according to claim 1, wherein the housing comprises a top part and a bottom part, the top part is formed as a cover, which rests on the bottom part, the supply of bags is located in the top part, and the dispensing gap, to which the tear off device for the bags is associated, is formed in one of the side walls of the top part.

5. The dispensing apparatus according to claim 4, wherein the top part has a container, which is open on one side, the container has side walls and a floor, which forms the cover, the mouth or opening of such a container is closable by the bottom part, and the dispensing gap.

6. The dispensing apparatus according to claim 1, wherein the device for mounting the roll is situated in the container, the device having at least one pair of holders for the supply roll, which contains the bags, one of these bearing points is fixed, and the other of these bearing points is formed so as to yield.

7. The dispensing apparatus according to claim 6, wherein the bearing points contain at least one disc, this disc has a circular outer contour, an opening is formed in the center of the disc main body, this central opening is enclosed by at least one bead, which is located on one of the sides of the disc main body, the disc main body is provided with holes, which are situated in pairs and which are usable for fastening the disc, the yielding bearing point has two such discs and an essentially cylindrical pin, the diameter of the central opening in the disc is selected so that the main body of the pin may be inserted through this opening, and the pin main body is enclosed by a compression spring, which is located between the discs.

8. The dispensing apparatus according to claim 4, wherein the housing bottom part is formed as a hollow body, which is open on one side, the mouth of the bottom part is covered by the housing top part, and an opening is formed in one of the side walls of the housing top part, through which filled bags may be thrown into the housing.

* * * * *